United States Patent [19]

Topel

[11] Patent Number: 4,995,372

[45] Date of Patent: Feb. 26, 1991

[54] QUIVER HAVING A NECK-GRIPPING AND ALIGNMENT MECHANISM

[76] Inventor: Kenneth D. Topel, 11220 - 164th St. E., Puyallup, Wash. 98374

[21] Appl. No.: 358,454

[22] Filed: May 25, 1989

Related U.S. Application Data

[63] Continuation of Ser. No. 120,571, Nov. 12, 1987, abandoned.

[51] Int. Cl.[5] ..... F41B 5/06

[52] U.S. Cl. ..... 124/25.5; 124/25.7; 124/41.1; 124/88; 224/916; 206/315.11

[58] Field of Search ..... 124/23 A, 24 A, 41 R, 124/80, 45, 88, 86, 25.5, 25.7, 41.1; 224/916; 206/315.11; 248/225.1, 223.4, 230; 403/396, 391, 389, 381, 109, 110, 104

[56] References Cited

U.S. PATENT DOCUMENTS

| | | | |
|---|---|---|---|
| 2,587,155 | 2/1952 | Harvey | 124/23 A |
| 2,771,620 | 11/1956 | Hoffman | 206/315.11 |
| 3,209,740 | 10/1965 | Hanch | 124/24 A |
| 3,366,101 | 1/1968 | Saunders | 124/88 |
| 3,490,662 | 1/1970 | Ramsey | 124/41 R |
| 3,591,062 | 7/1971 | Karbo | 124/41 R |
| 3,696,978 | 10/1972 | Gentellalli | 206/315.11 |
| 3,716,174 | 2/1973 | Ehlert | 124/41 R |
| 4,133,427 | 1/1979 | Loomis | 206/315.11 X |
| 4,273,465 | 6/1981 | Schoen | 403/389 X |
| 4,547,092 | 10/1985 | Vetter et al. | 403/389 X |
| 4,607,606 | 8/1986 | Schaar | 124/88 X |
| 4,621,606 | 11/1986 | Toth | 124/24 A |
| 4,635,611 | 1/1987 | Priebe | 403/381 X |

*Primary Examiner*—Peter M. Cuomo

*Attorney, Agent, or Firm*—Christensen, O'Connor, Johnson & Kindness

[57] ABSTRACT

A quiver is adapted for detachable mounting on an archery bow to hold hunting arrows, while they are spaced upright with their sharp hunting heads quickly, releasably positioned in a protective hood above, and with their nocks quickly, releasably held below on a cross-retainer or nock bar, while all their nocks are aligned. The arrows are removed upon a quick uplifting motion, followed by a quick offset lowering motion, and then followed by a ninety-degree vertical rotational motion, whereby the nock of a withdrawn arrow is in alignment for quickly fitting the bowstring in a shooting position. To accommodate groups of arrows having the same overall lengths, which are different from groups of arrow having the same common longer or shorter lengths, an embodiment of the quiver is longitudinally adjustable. The nocks preferably snap on and snap off the cross-retainer. The sharp hunting heads have their entry portions positioned in a resilient material within the protective hold.

11 Claims, 3 Drawing Sheets

FIG. 7
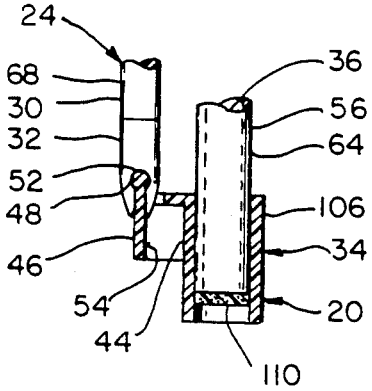
FIG. 8
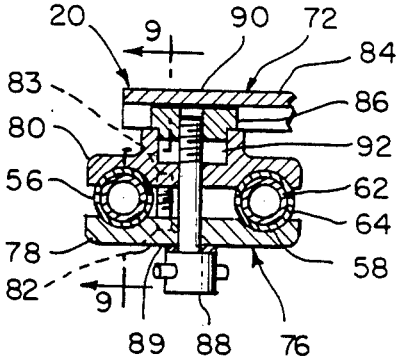
FIG. 9
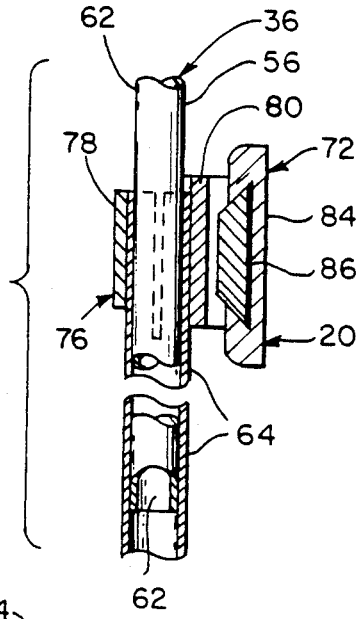
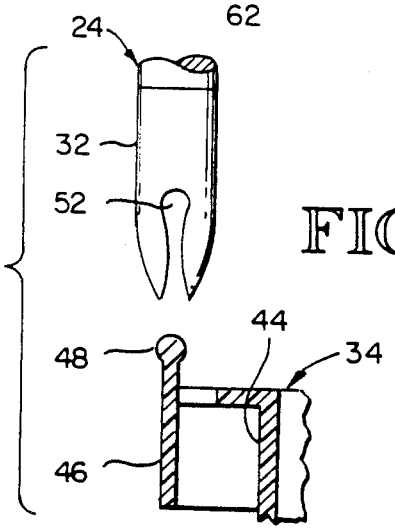
FIG. 6
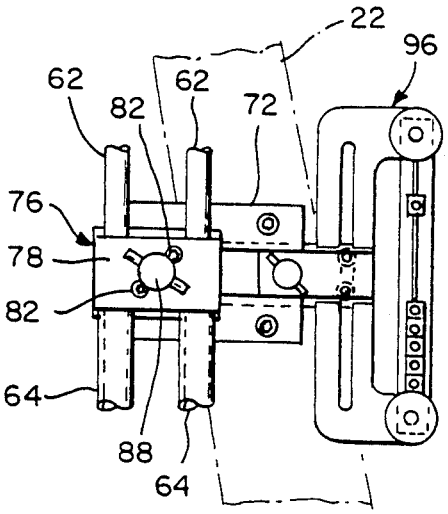
FIG. 10

QUIVER HAVING A NECK-GRIPPING AND ALIGNMENT MECHANISM

CROSS-REFERENCE TO RELATED APPLICATION

This application is a continuation application based on prior copending application Ser. No. 07/120,571, filed on Nov. 12, 1987, now abandoned.

BACKGROUND

In respect to holding hunting arrows, Messrs. King, Schampel and Becking, in U.S. Pat. No. 2,722,958 issued in 1955, provided a quiver, strappable to an archer's back, holding arrows upright with their hunting heads below and exposed, and their nock ends protected above, with resilient materials receiving both the entry portions of their points below and the nock ends above. Later, in 1972, Gerald Gentellalli in U.S. Pat. No. 3,696,978, provided an adjustable length quiver, strappable to an archer's back, holding arrows upright with their hunting heads below, partially exposed, and their nock ends protected above within a rectangular covered enclosure.

Other persons have provided quivers attachable to hunting bows, placing the hunting arrows upright when the hunting bow is held vertically in the shooting position. In 1961, Bert Haggard provided an arrow-holding attachment leaving both the hunting heads and nocks exposed, with the shafts of the arrows being removably held at one location spaced downwardly from the arrowhead, and at another location spaced upwardly from the nocks. In 1963, James Ramsey, in U.S. Pat. No. 3,108,725, disclosed his arrow holder for bows wherein the hunting heads were protectively received above and the depending arrow shafts were received in notches in a lower plate located well above the nocked ends. In 1971, James Ramsey, in U.S. Pat. No. 3,561,651, provided a quiver attachable to an archer's bow to protectively hold the arrows in an upright position with the hunting heads held from above and the arrow shafts held at a point spaced from the nocks. In 1973, Harry Ehlert, in U.S. Pat. No. 3,716,174, disclosed a bow-mounted arrow quiver protecting hunting heads above and received arrow shafts below, having a vertical support, in turn, secured above and below to the bow. In 1981, Arthur Spitzke, in U.S. Pat. No. 4,252,101, provided a detachable bow-mounted quiver having an upright support secured to the bow and, in turn, providing a protective cover above to receive the hunting heads and a lower receiver to hold the arrow shafts at about their mid lengths. Later in 1982 Arthur Spitzke, in U.S. Pat. No. 4,363,312, illustrated and described a similar bow-mounted quiver. In 1986, John Schaar, in U.S. Pat. No. 4,607,606, disclosed a bow-mounted quiver having an upright support secured to the bow, in turn, providing a protective cover above for hunting heads substantially pushed into a filler material, such as rubber or styrofoam, and an arrangement of snap-in receivers below to receive arrow shafts at about their mid length.

These quivers supported on an archer's back or on an archer's bow have served and serve archers well. However, there remained a need for having a quiver detachably supported on a bow, which could securely hold a hunting arrow in place, with the sharp hunting head well protected and the arrow held securely until intentionally released by the archer, and with the nock directly held in the same aligned position with the other nocks.

SUMMARY

A quiver is provided for detachable mounting to an archery bow to hold hunting arrows at each of their ends, so the arrows will not be inadvertently dislodged. The hunting heads are protected in a protective hood to, in turn, protect the archer and others hunting with him. The points of the arrowheads are embedded in a resilient material positioned within the protective hood, only to the extent to keep them slightly spaced from one another, and to allow their slight upward movement during both their intentional insertion and withdrawal. The fletched ends at their respective nocked ends are spaced and held in like alignment on a transverse support or nock bar, with an upstanding edge thereof having a radiused top portion. The nock of each arrow snaps over the radiused edge of the nock bar to hold the arrow securely in the quiver. A vertical support, preferably of changeable length, positions the protective hood and the transverse support, and, in turn, is detachably secured to the bow. The hunting arrows are intentionally removed, during hunting, upon a quick uplifting motion, followed by a quick offset lowering motion, and then followed by a ninety-degree vertical rotational motion, whereby the nock of a withdrawn arrow is in alignment for quickly fitting the bowstring in the shooting position of the hunting arrow.

DRAWINGS

The quiver detachably mounted on an archery bow to protectively and securely hold hunting arrows, when their nocks are supported and aligned is illustrated in the drawings, wherein:

FIG. 1 is a perspective view illustrating how this quiver is detachably mounted on an archer's bow to hold the hunting arrows upright when the bow is in the shooting position, and to indicate how the quiver and a bow sight are both conveniently and detachably mounted on the bow at the same locale;

FIG. 2 is a side view of the quiver with portions removed to reduce the illustrated length, and with portions removed to illustrate how the hunting heads or broadheads are protected and held at the entry portions of the hunting heads in a resilient material within the protective hood, with space left for slight upward movement upon either the intentional insertion or withdrawal of the hunting arrow, and with portions removed to show how the nocks of the hunting arrows are held in alignment, and with all the portions shown of a dovetailed transverse support that holds the telescoping vertical support in place and that is secured to the bow, thereby positioning the protective hood and transverse support or receiver to conveniently receive and withdraw hunting arrows, yet to securely hold the hunting arrows when the filled quiver and bow are being transported;

FIG. 3 is a front view of the quiver with portions removed for like illustrative purposes, as explained in reference to FIG. 2, further illustrating how the telescoping vertical support is gripped by the transverse support where the smaller diameter member enters the larger diameter member, and how the nock of each arrow is held and aligned, and how the sharp edges of the broadhead or hunting head are surrounded by the depending portions of the protective hood;

FIGS. 6 and 7 show how the nock of the fletched end of a hunting arrow is snapped into place along an edge of the transverse support, which has a radiused top portion complementarily fitting the nock, which is then aligned with the other nocks of adjacent spaced hunting arrows also secured in the quiver;

FIG. 8 is a sectional view taken on line 8—8 of FIG. 2, illustrating how the quiver is secured to the bow using the dovetail mounting, and also showing how the telescoping members of the vertical arrow support are secured at the same locale;

FIG. 9 is a sectional view taken on line 9—9 of FIG. 8, also illustrating how the quiver is secured to the bow using the dovetail mounting, and also showing how the telescoping members of the vertical arrow support are secured at this same locale; and FIG. 10 is a partial side view illustrating how the dovetail mounting of the quiver is extended to also serve as the dovetail mounting of a bow sight.

DESCRIPTION OF THE PREFERRED EMBODIMENT

General Arrangement

Figure 1:
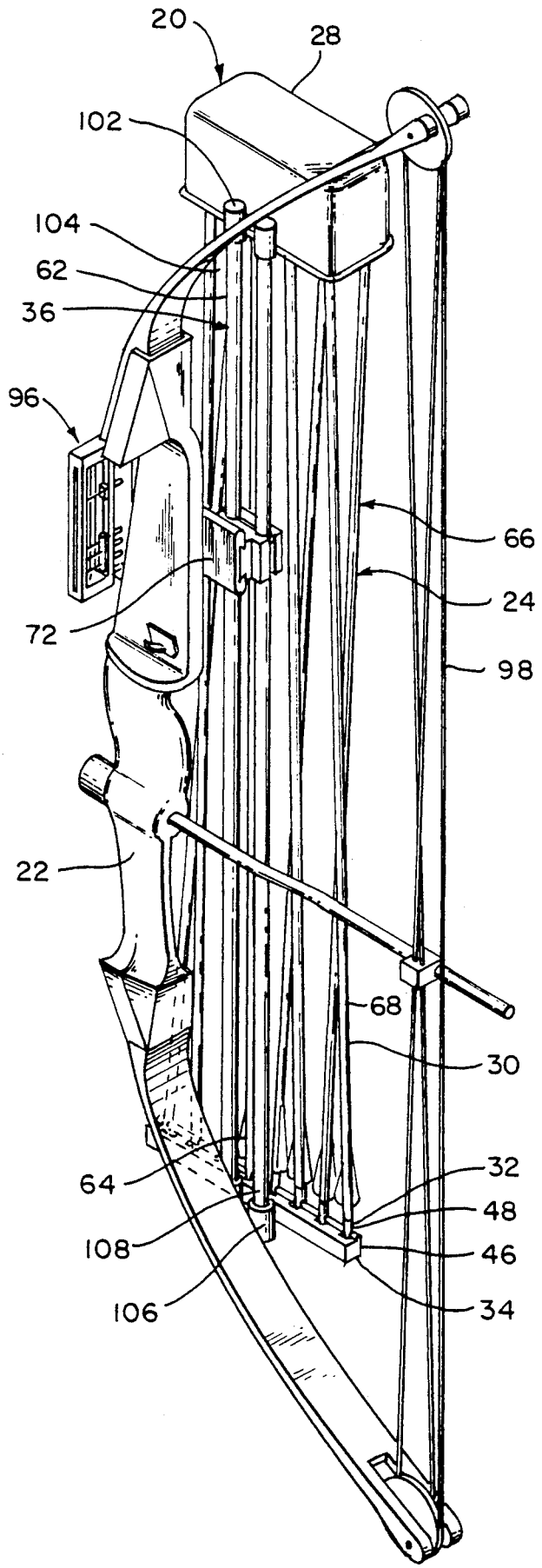
Figure 2:
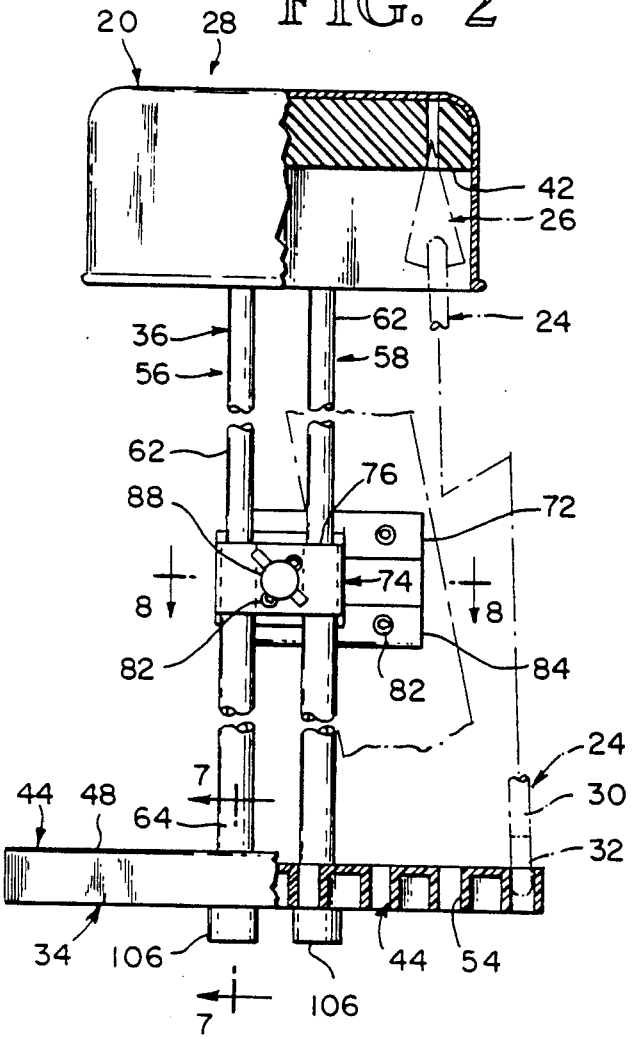
Figure 3:
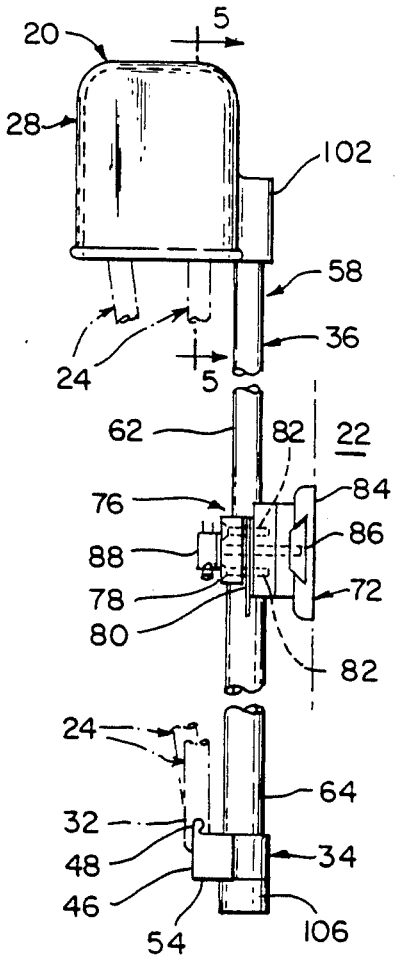

The preferred embodiment of the quiver 20 is illustrated throughout the drawings. As shown in FIGS. 1, 2, and 3, the quiver 20 is conveniently, quickly, and detachably mounted on an archer's bow 22 to hold the hunting arrows 24 upright, when the bow 22 is held in the shooting position. The hunting heads 26, or broadheads 26, are above and protectively held in a protective hood 28. The fletching ends 30 of the arrows 24 are below and the nocks 32 thereof are all aligned and snapped in place on a cross-retainer or nock bar 34. The protective hood 28 above and the cross-retainer 34 below are positioned by a vertical arrow support 36, which, in turn, is secured to the bow 22 by a dovetail mounting 38.

The Protective Hood

Figure 4:
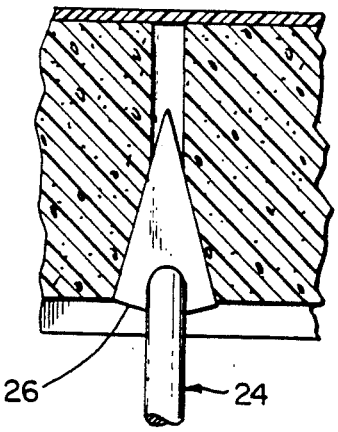
FIG. 4 PRIOR ART
FIG. 4 illustrates how prior quivers received greater portions of the hunting heads.
Figure 5:
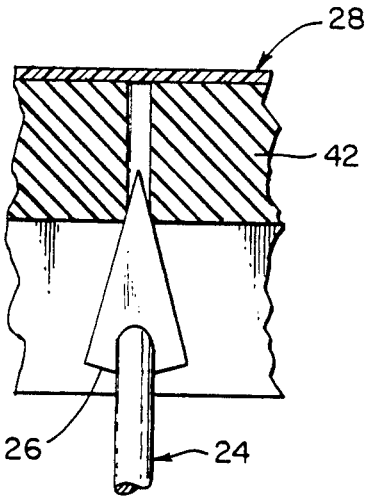
FIG. 5 illustrates how this quiver receives lesser portions of the hunting heads of the hunting arrows, whereby moisture drains away better from the resilient material locales where the hunting heads are positioned and retained.

As shown in FIG. 4, other protective hoods have received the hunting heads 26 to a greater extent within a resilient material 42. During high-moisture periods rusting of the otherwise sharp broadheads 26 has occurred. Therefore, as shown in FIG. 5, the resilient material 42 is arranged to make less contact with the sharp edges of the hunting heads 26, while they are protectively retained within the protective hood 28.

The Transverse Support or Nock Bar

As shown in FIGS. 1, 2, 3, 6, and 7, the nock 32 of each arrow 24 is snapped in and out of a specific locale 44 that is one of several spaced across a transverse support or nock bar 34. At each locale 44, there is an upstanding wall 46, having a radiused top edge 48. This top edge 48 is received by the nock 32 of the arrow 24, which has a partial circular recess 52, which specifically receives the radiused top edge 48.

The nock bar 34 preferably has box-like openings 54 at spaced locales 44, one side of which is the upstanding wall 46. Therefore, when the nock 32 is snapped over the radiused top edge 48, the nock 32 is protectively surrounded within the box-like opening 54. The engagement of the nock 32 with wall 46 prevents rotation of the arrow about the axis of its shaft 24. The nock is also held by the sidewalls of the box-like opening 54 from transverse motion. This securement of the nock 32, after the initial placement of the hunting head 26 within the protective hood 28, while positioned in the resilient material 42 therein, very adequately holds each arrow 24 in place, until the archer intentionally removes an arrow 24. There is enough depth of the resilient material 42, whereby, upon the placement or removal of an arrow 24 from the quiver 20, the arrowhead 26 is moved sufficiently into the resilient material 42 to clear the nock 32 from the edge 48 of upstanding wall 46.

Vertical Arrow Support

The vertical arrow support 36 positioning the protective hood 28 above and the nock bar 34 below, as shown in FIGS. 1, 2, and 3, preferably has two spaced parallel longitudinal members 56, 58. Each of these, in turn, has telescoping members 62, 64, whereby the overall length of the vertical arrow support 36 is adjustable to receive a group 66 of hunting arrows, which have a selected length of an arrow shaft 68 preferred by a particular archer.

Dovetailed Mounting

A dovetailed mounting 72, as particularly shown in FIGS. 8, 9, and 20, is used to detachably secure the quiver 20 the bow 22. The hollow rods or tubes serving as the telescoping members 62, 64 are first secured together at their interfitting locale 74 by using the clamping assembly 76. The outside portion 78 thereof and the inside portion 80 thereof are held in the clamping position by two threaded fasteners 82, passed through the outside portion 78 and threaded into the inside portion 80, via holes 83. When these fasteners 82 are tightened, the quiver 20 is then ready for detachable securement to the bow 22.

A receiving base member 84 of the dovetail mounting 72 is secured to the bow 22 also by using threaded fasteners 82. Then the sliding positioning member 86 is endwise transversely inserted in the receiving base member 84, as illustrated in FIGS. 8 and 9. Then the detachable mounting of the quiver 20 is undertaken by passing the larger threaded fastener 88 through both the outside portion 78 and the inside portion 80 of the clamping assembly 76, via holes 89, and beyond through the threaded hole 90 in the sliding positioning member 86 into frictional contact with the receiving base member 84.

As shown in FIG. 8, the inside portion 80 of the clamping assembly 76 has a receiving channel portion 92 to fit about a portion of the sliding positioning member 86. Therefore, when the quiver 20 is finally positioned along the receiving base member 72 of the dovetail mounting 72, the tightening of the larger threaded fastener 88 firmly positions the quiver 20 in the selected position on the bow 22.

Dovetail Mounting Also Receives Bow Sight

As shown in FIG. 10, the receiving base member 84 of the dovetail mounting 72 is preferably made long enough to accommodate another sliding positioning member 94, which is used in supporting a bow sight 96.

The Removal of Arrows When Hunting

When an archer is hunting, his or her hunting arrows 24 are very securely held so they will not be inadvertently dislodged from the quiver 20. Yet when a shot is to be made, the archer reasonably easily removes the arrow 24 from the quiver 20. The arrow 24 is raised upwardly to clear the nock 32 from the radiused top edge 48 of the wall 46, then moved slightly clear of wall 46, and then swung in a vertical plane for placement in the shooting position.

During this swinging motion, the arrow 24 is not rotated about the longitudinal axis thereof. Therefore, the nock 32 remains in a position that is aligned for direct positioning on the bowstring 98. When the next shot is to be made, often as quickly as possible, the archer follows the same removal steps, and he or she is assured the nock 32 will again be aligned for direct positioning on the bowstring 98.

Specifications of a Specific Embodiment

The protective hood, about $5.5 \times 2.5 \times 2.0$ inches, is made of a plastic material designated as ABS. Two alike cylindrical recesses 102 thereof receive the ends 104 of the telescoping members 62, which are about 0.43 inch in diameter, and are made of aluminum.

The transverse support, about $7.5 \times 1.25 \times 1.0$ inches, is also made of plastic material designated as ABS. Two alike cylindrical recesses 106 thereof receive the ends 108 of the telescoping members 64, which are about 0.50 inch in diameter, and are made of aluminum.

The resilient material 42 is about 1.25 inches deep and adhesively secured within the protective hood 28. Set screws are used to secure the telescoping members 64 in place at their ends 108 into cylindrical recesses 34 of the transverse support 34.

The box-like openings 54 at the locales 44 across the transverse support 34 are preferably eight in number, about 0.5 inch deep and 0.3 inch square, presenting the wall 46 of 0.09 inch in thickness, capped with the 0.110 inch radiused top edge 48. The nocks 32 are firmly snapped in place and so protected in these box-like openings 54, while all are aligned for quick placement on the bowstring 98.

I claim:

1. A quiver for holding a plurality of arrows, each of said arrows including a point, a nock, and a shaft joining said point and said nock, said quiver comprising:

first means for releasably holding the points of said arrows in spaced relationship to one another;

second means for releasably engaging the nocks of said arrows in spaced relationship to one another, said second means including a nock bar having discrete arrow separation means for receiving said nocks, each said separation means holding one nock, said arrow separation means including a series of adjacent boxlike compartments having a first wall separating each compartment from the next and a second wall that includes a nock-receiving edge that fits into a slot formed in the nock of said arrow; and a mounting bar connecting said first and second means.

2. The quiver of claim 1, wherein said nock-receiving edge is radiused to snap into the slot of said nock with positive holding force to resist the removal of said nock from said radiused edge.

3. The quiver of claim 1, further including length adjustment means associated with said mounting bar for varying the length of said mounting bar.

4. The quiver of claim 1, wherein said first means includes a pad of resilient material that accepts the points of said arrows.

5. The quiver of claim 4, wherein said first means further includes a hood surrounding said pad.

6. The quiver of claim 1, wherein said mounting bar includes a pair of spaced telescoping longitudinal members attached at a first end thereof to said first means and at a second end thereof to said second means and further including a transverse support secured about said longitudinal members to hold them at a desired length.

7. The quiver of claim 6, wherein said transverse support includes a first portion and a second portion, said first and second portions dovetailed together, one of said portions thereof holding the telescoping members together and the other portion thereof adapted for securement to a bow.

8. A quiver for holding a plurality of arrows, each of said arrows including a point, a nock, and a shaft joining said point and said nock, said quiver comprising:

first means for releasably holding the points of said arrows in spaced relationship to one another;

second means for releasably engaging the nocks of said arrows in spaced relationship to one another, said second means including a nock bar having discrete arrow separation means for receiving said nocks, each said separation means holding one nock; and a mounting bar connecting said first and second means, said mounting bar including a pair of spaced telescoping longitudinal members attached at a first end thereof to said first means and a second end thereof to said second means and further including a transverse support secured about said longitudinal members to hold them at a desired length, said transverse support including a first portion and a second portion, said first and second portions dovetailed together, one of said portions thereof holding the telescoping members together and the other portion thereof adapted for securement to a bow, said one portion of said transverse support that holds said telescoping members including two opposing clamping members, said clamping members including fastening members associated therewith to draw said clamping members toward one another to hold said telescoping members together at a selected overall length.

9. The quiver of claim 8, wherein one portion of said opposing clamping members has a dovetailed block interfitted therewith, which, in turn, interfits the other portion, which is adapted for securement to a bow.

10. The quiver of claim 9, wherein a fastener is utilized to draw the one portion having the two opposing clamping members and also the dovetailed block together after the dovetailed block has been inserted in place during the dovetailed joining together of the two portions of the transverse support.

11. The quiver of claim 10, further including fasteners to hold the other portion of the transverse support on a bow.

* * * * *

UNITED STATES PATENT AND TRADEMARK OFFICE

CERTIFICATE OF CORRECTION

PATENT NO. : 4,995,372

DATED : February 26, 1991

INVENTOR(S) : Kenneth D. Topel

It is certified that error appears in the above-identified patent and that said Letters Patent is hereby corrected as shown below:

Title page; Item [54] ,Column 1, lines 1-2, should read delete "NECK" and insert therefor --NOCK--
delete "NECK" and insert therefor --NOCK--

Signed and Sealed this

Twenty-ninth Day of December, 1992

*Attest:*

DOUGLAS B. COMER

*Attesting Officer*

*Acting Commissioner of Patents and Trademarks*